US006469681B2

(12) United States Patent
Jones et al.

(10) Patent No.: US 6,469,681 B2
(45) **Date of Patent: *Oct. 22, 2002**

(54) REMOVABLE ANTENNA FOR CONNECTION TO MINIATURE MODULAR JACKS

(75) Inventors: Jeffrey L. Jones, Orem; David Oliphant, West Valley City; David Andrus, Provo; Tom Johnson, Draper, all of UT (US)

(73) Assignee: 3Com Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/416,247

(22) Filed: Oct. 12, 1999

(65) Prior Publication Data

US 2001/0054985 A1 Dec. 27, 2001

(51) Int. Cl.[7] ..... H01Q 1/10; H01Q 1/24
(52) U.S. Cl. ..... 343/906; 439/676; 343/702
(58) Field of Search ..... 343/702, 700 MS, 343/900, 901, 906; 439/131, 344, 676, 916, 135; H01Q 1/10; H01R 23/02

(56) References Cited

U.S. PATENT DOCUMENTS

| | | | | | |
|---|---|---|---|---|---|
| 3,254,344 | A | * | 5/1966 | Rohrs | 343/901 |
| 4,695,925 | A | | 9/1987 | Kodai et al. | 361/737 |
| 5,183,404 | A | * | 2/1993 | Aldous et al. | 439/55 |
| 5,338,210 | A | | 8/1994 | Beckham et al. | 439/131 |
| 5,448,256 | A | * | 9/1995 | Ohashi et al. | 343/878 |
| 5,727,966 | A | * | 3/1998 | Alpert | 439/418 |
| 5,773,332 | A | * | 6/1998 | Glad | 439/344 |
| 5,781,612 | A | * | 7/1998 | Choi et al. | 379/58 |
| 5,816,832 | A | | 10/1998 | Aldous et al. | 439/131 |
| 5,828,343 | A | * | 10/1998 | MacDonald, Jr. et al. | 343/702 |
| 5,867,131 | A | * | 2/1999 | Camp, Jr. et al. | 343/797 |
| 5,918,163 | A | * | 6/1999 | Rossi | 455/90 |
| 5,926,138 | A | * | 7/1999 | Eerikainen | 343/702 |
| 5,971,777 | A | | 10/1999 | Garside | 439/131 |
| 5,973,645 | A | * | 10/1999 | Zigler et al. | 343/702 |
| 5,975,927 | A | | 11/1999 | Giles | 439/131 |
| 6,033,240 | A | | 3/2000 | Goff | 439/131 |
| 6,054,954 | A | * | 4/2000 | Eggleston et al. | 343/700 MS |
| 6,059,583 | A | | 5/2000 | Croft et al. | 439/131 |
| 6,089,922 | A | * | 7/2000 | Glad et al. | 439/676 |
| 6,115,256 | A | * | 9/2000 | Centofante | 361/737 |
| 6,164,989 | A | * | 12/2000 | Glad et al. | 439/131 |
| 6,174,205 | B1 | * | 1/2001 | Madsen et al. | 439/638 |
| 6,295,207 | B1 | * | 9/2001 | Jones | 361/737 |

* cited by examiner

*Primary Examiner*—Den Wong
*Assistant Examiner*—Trinh Vo Dinh
(74) *Attorney, Agent, or Firm*—Kirton & McConkie; Michael F. Krieger

(57) ABSTRACT

The present invention relates to an antenna which is configured to plug into a retractable connector on an electronic apparatus. Some embodiments of the present invention may be configured to plug into common RJ-11 or RJ-45 jacks allowing devices equipped with these jack to utilize external antennas to increase range and functionality. Further, some embodiments of the present invention comprise at least a partial ground plane located in the antenna plug which connects to a jack. The present invention also comprises connectors such as RJ jacks which comprise ground plane elements which may be used to improve antenna range and efficiency.

19 Claims, 3 Drawing Sheets

REMOVABLE ANTENNA FOR CONNECTION TO MINIATURE MODULAR JACKS

THE FIELD OF THE INVENTION

The present invention relates to portable antennas which connect directly to physical/electrical media connectors used in the computer and communications industry. More particularly, the present invention relates to an antenna which can be connected to the miniature 8- and 6-position jacks commonly known as RJ-11 and RJ-45 jacks. This type of antenna is useful in combination electronic devices which utilize both wireless and wired communications networks.

BACKGROUND

Some standards in the electrical connector industry have been created by government regulation such as the Federal Communications Commission's Title 47, §68.500, otherwise denoted "Subpart F—Connectors" (Subpart F). Subpart F is incorporated herein by reference. Subpart F contains detailed specifications for "miniature" connectors used in the communications industry. Included in this specification are the "Miniature 6-position plug and jack" and the "Miniature 8-position plug and jack." These connectors, commonly known as the RJ-11 connector and the RJ-45 connectors, respectively, are ubiquitous throughout the industry.

The miniature 6-position connector or RJ-11 has emerged as the industry standard connector for telephone lines. RJ-11 plugs and jacks are used on almost all telephone sets for connection to the phone system and consequently are used for standard modem connections which also use these telephone lines. Although most telephone companies use only 4 or 2 of the available positions on the connector, the 6-position connector is the standard.

The miniature 8-position connector or RJ-45 has become an industry standard connector for computer networks. It is used for inter-connectivity between network adapter cards, hubs, routers, switches and other network hardware.

These connectors have been the industry standard for many years and are likely to remain so in the future for telephones, desktop computer modems and network adapters, and other substantially stationary communications equipment. However, hardware technology and the "miniaturization" of components has progressed to the point that the standard, "miniature" RJ connectors have a larger cross-section than the thickness of the hardware to which they connect.

An example of these smaller, thin profile hardware configurations is the PC Card Standard promulgated by the Personal Computer Memory Card International Association (PCMCIA). The PCMCIA PC Card standard identifies three primary card type designations: Type I, II and III. These type designations correspond to physical dimension restrictions or "form factors" of 85.6 mm (length)×54.0 mm (width) and thicknesses of 3.3 mm, 5.0 mm and 10.5 mm respectively. These thin profile expansion cards are used to expand the functionality of computers and related products by adding circuitry contained on the card to the host device. Host devices, such as laptop computers, contain expansion slots which receive the expansion cards and provide electrical connections thereto. Modems and network adapters are often constructed in PC Card standard form factor.

As a consequence of hardware miniaturization in the face of a nearly worldwide RJ connector standard, hardware manufacturers have developed myriad proprietary hardware connection standards and an assortment of connectors and adapters that allow the RJ plugs to be connected to thin profile hardware.

One elegant and convenient connector which allows connection of the standard RJ type plug with thin profile hardware is the XJACK® produced by 3Com Corporation, Salt Lake City, Utah. The XJACK®, shown generally in FIG. 1, is a thin profile connector designed to be contained within hardware such as PC Card standard compliant devices. The XJACK® comprises a thin body 2 with an aperture 4 therein for receiving a standard RJ connector plug 6 such as a miniature 6-pin plug, a miniature 8-pin plug or some other connector. Jack conductors 8 contact plug conductors 10 just as a conventional RJ jack connects. The XJACKS® may be retractable within the device or be detachable therefrom. Commonly used XJACK® connectors retract in and out of a device by sliding along a track. A spring is often used to bias the XJACK® connector such that it pops out of its retracted state and remains extended during use.

Wireless communication devices are now becoming commonplace in the electronics industry. Wireless networking of portable computers and associated devices is now replacing a large segment of the networking market. Wireless communication devices including wireless networking adapters, hubs and other equipment utilize radio transmitters and receivers to transmit data signals from one device or node to another. These radio transmitters and receivers must utilize a specific frequency band and protocol to accomplish this task. Since these wireless networks and communications areas may often overlap, standards, protocols and privacy protection are necessary. One current standard in the industry has been established by the Institute of Electrical and Electronics Engineers, Inc. (IEEE) and is known as IEEE 802.11. This standard comprises communications standards, protocol and equipment specifications for wireless communication equipment including privacy and encryption provisions.

Another emerging standard in wireless communications and networking, known as Bluetooth®, is being established by a collaborative group of communications and computing companies. Devices incorporating Bluetooth® technology will utilize a micro-chip transceiver for communications between devices. Bluetooth® devices will transmit in the previously unused 2.4 GHz range. Bluetooth® technology promises to be a viable and economical networking solution for interconnection of cell phones, computers, printers, modems, computer peripherals, fax machines and other communications and computing devices. The size of the Bluetooth® transceiver will make it usable in devices as small as palm computers and cell phones.

Antennas are well known for enabling and improving transmission to radio receivers and from radio transmitters. Antennas can dramatically increase the range of radio transceivers, however most antenna designs function best when protruding from their host device. In small electronic devices protruding antennas are often vulnerable to breakage as the devices are often stowed in purses, pockets, backpacks and other areas where neglect can occur. Often a removable antenna is more convenient and durable.

When antennas are incorporated into thin-profile devices such as PC Card standard expansion cards, very little space is available for the antenna and connections thereto. This lack of space limits the size of the antenna and accordingly its range. Removable external antennas can be larger than internal antennas and therefore obtain better reception and range.

While wireless technology is fast replacing a large segment of the communications and networking industry, wired equipment is still prevalent. A communications or computing device, such as a portable computer, which can connect to both wireless and conventionally wired networks will be more adaptable and convenient at the present time. A device or expansion card which provides connectivity to both wired and wireless technology is extremely useful.

SUMMARY AND OBJECTS OF THE INVENTION

The present invention relates to detachable antennas which couple with standard connectors on electronic devices. Many electronic apparatus comprise physical/electrical media connectors which are used to connect to communications networks such as telephone networks or computer networks. This is often done by connecting a telephone or network cable to the connector on the apparatus.

Wireless communications devices are becoming extremely common especially in the fields of telephone communications and computer network communications. Wireless local area networks (LAN's) and even wide area networks (WAN's) are now widespread. Because portable computing devices may need to interface with both wireless and conventional wired networks, a combination network adapter or modem which accommodates both wired and wireless communications can be useful. These combination devices must often fit into a device with a very small form factor or thin profile. Consequently, space for both a wired connector and a separate antenna is often difficult to find. Embodiments of the present invention comprise a detachable antenna which can be connected to a wired connector on a device and which obviates the need for an internal antenna on the device. Some embodiments of the present invention also allow the antenna to be designed larger than an internal antenna allowing increased frequency ranges and improved performance.

Some embodiments of the present invention also comprise a partial or full ground plane contained in the portion of the removable antenna which plugs into the connector. A ground plane may also be built into the connector itself. For example, and not by way of limitation, an XJACK® or other retractable thin profile jack may be constructed with a ground plane element therein to enhance antenna performance. The plug portion of the antenna which inserts into the XJACK® may also have a ground plane element which complements the ground plane in the XJACK®.

Some embodiments of the present invention may also comprise switching circuitry which automatically activates or switches to a wireless device when the antenna is inserted into a connector. When the antenna is removed, the device switches to a wired device. For example, and not by way of limitation, a combination wireless network adapter and wired network adapter may be contained in a single expansion card. When the antenna is inserted, the circuitry automatically activates the wireless adapter and when the antenna is removed, the wired adapter is activated. The same principle may be used for a wired/wireless modem combination.

Accordingly, it is an object of some embodiments of the present invention to provide an antenna which is configured to connect with conventional cable connectors.

It is also an object of some embodiments of the present invention to provide an antenna which can be used with thin profile devices without room for internal antennas.

It is another object of some embodiments of the present invention to provide a combination electronic device which can be used with both wired and wireless communications networks.

These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 2:
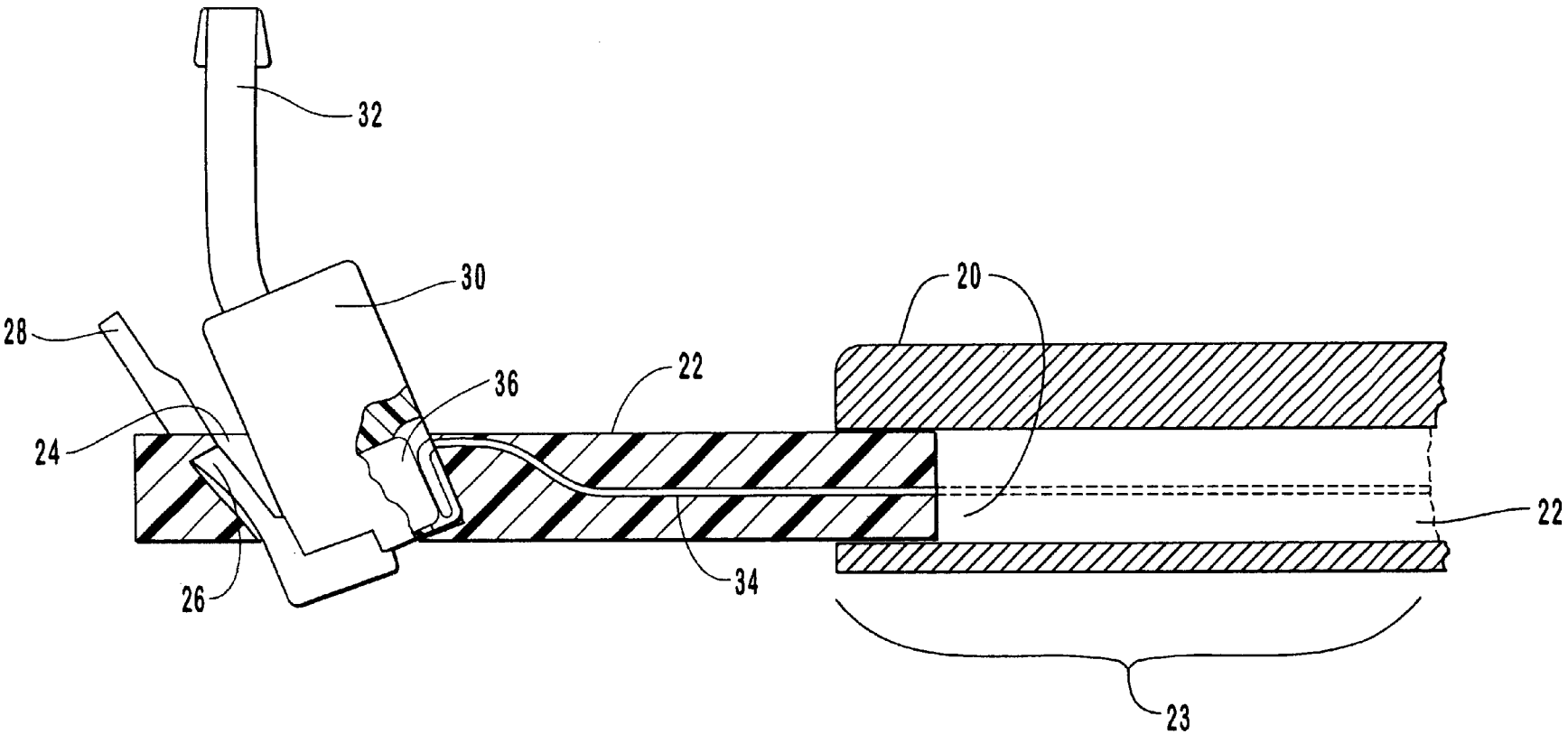
FIG. 2 is a cross-sectional view of a retractable connector of an electronic device showing a removable antenna inserted therein.
Figure 3:
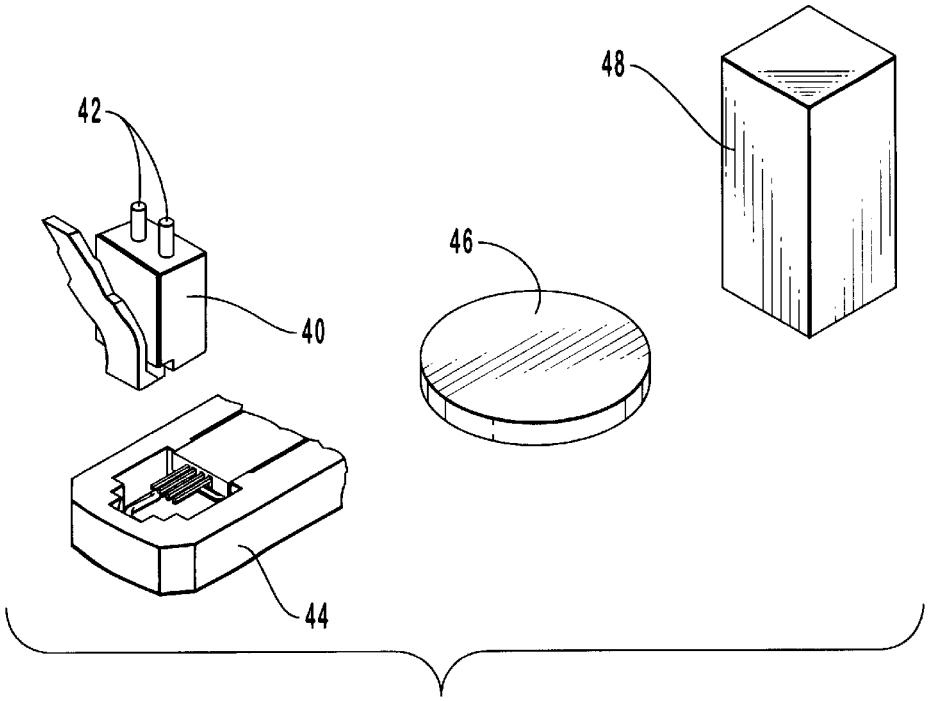
FIG. 3 is a perspective view of a modular embodiment of the present invention with alternative antenna attachments.
Figure 4:
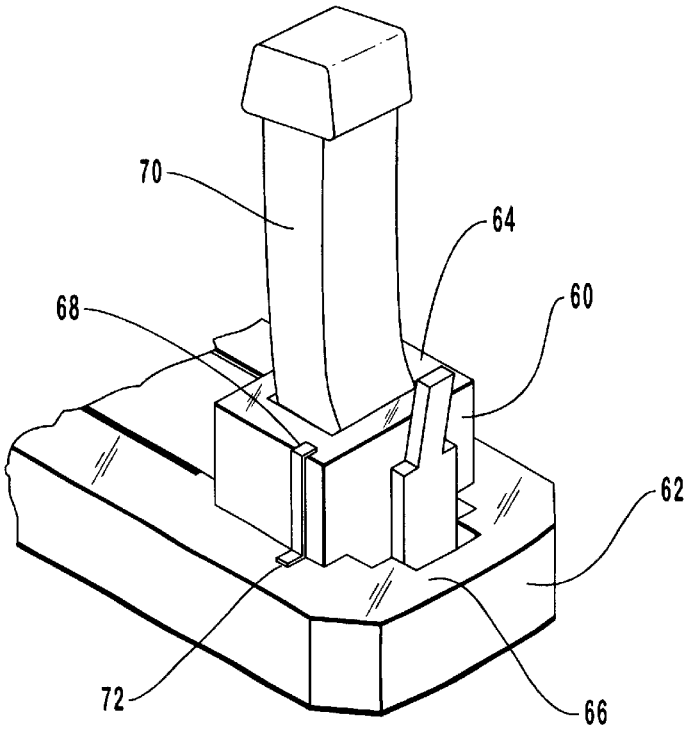
FIG. 4 is a perspective view of an embodiment of the present invention comprising ground plane elements.

It will be readily understood that the components of the present invention, as generally described and illustrated in the Figures herein, could be arranged and designed in a wide variety of different configurations. Thus, the following more detailed description of the embodiments of the system and apparatus of the present invention, as represented in FIGS. 2 through 4, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

The Personal Computer Memory Card International Association (PCMCIA) promulgates the PC Card Standard for thin profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type designation. Type I, II, and III PC Cards have thicknesses of 3.3 mm, 5.0 mm and 10.5 mm respectively. Any references to the PC Card Standard or PCMCIA card standard refer to electronic cards substantially conforming to this standard as described herein.

The term miniature modular jack, physical/electrical media connector, fixed jack, XJACK®, alligator jack, and the like, connotes a media connector that may have qualities such as those connectors having physical attributes described in F.C.C. Part 68, Subpart F. Specific terms such as RJ-type, RJ-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors.

Figure 1:
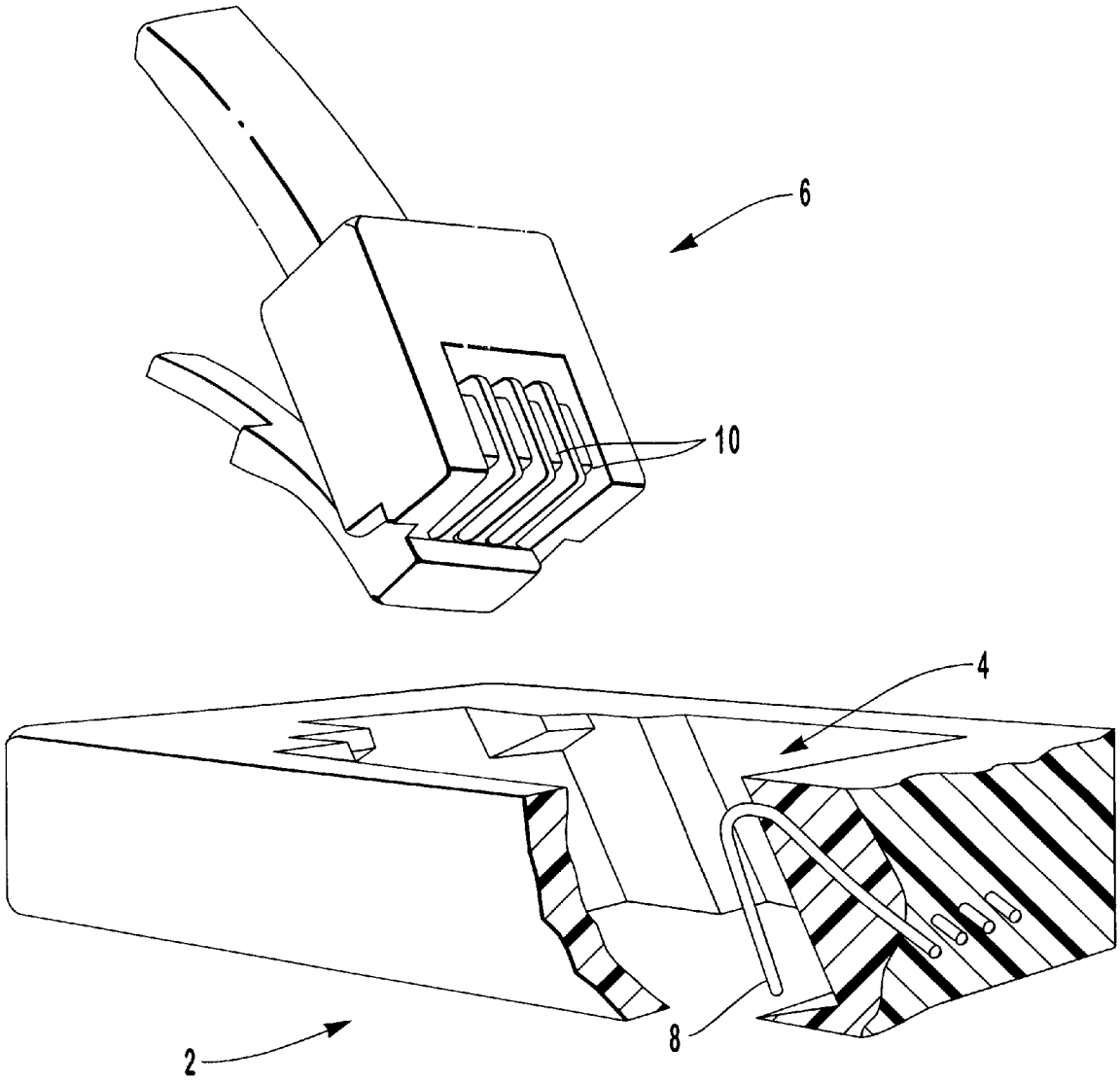
FIG. 1 (PRIOR ART)
FIG. 1 is a cut-away perspective view of a retractable connector.

In reference to FIG. 2, a first embodiment of the present invention is shown in cross-section. Electronic apparatus 20 comprises a retractable jack 22 similar to the jack shown in FIG. 1. Retractable jack 22 has an aperture 24 therein for receiving a standard cable plug connector such as a miniature 8-pin or 6-pin plug as described in FCC Part 68, subpart F. Other connector formats may also be used. These connectors often have a locking mechanism 26 which holds the plug in place once it has been inserted into the jack. A tang 28 is typically pressed to release the locking mechanism 26. This first embodiment of the present invention comprises a plug base 30 which has the same general physical format as the cable connector plug shown in FIG. 1, however, instead of providing a cable connection, the plug base 30 of the present invention connects to an antenna 32. When plug base 30 is inserted into jack 22, plug base conductors 36 contact jack conductors 34 which provide electrical connections to apparatus 20.

Antenna 32 allows apparatus 20 to utilize wireless devices such as a wireless LAN adapter or a wireless modem. Antenna 32 may also be used to increase the range or reception quality of low power wireless devices which have small internal antennas. For example, and not by way of limitation, antenna 32 may be used to increase the range or reception of a Bluetooth® enabled wireless device. Antenna 32 may be a dipole, monopole, patch or other type of antenna. Antenna 32 may also have several physical configurations, for example and not by way of limitation, antenna 32 may be a flex antenna that can be arranged in various positions.

When antenna 32 is no longer in use, it may be easily removed by releasing locking mechanism 26 with a quick press on tang 28 as with similar cable connectors. After antenna removal, retractable jack 22 may be pressed into its retracted position and small format apparatus 20 may be placed in a pocket or other small area without being restricted by antenna 32.

A second embodiment of the present invention is shown in FIG. 3 where a modular plug base 40 is shown with antenna contacts 42. Plug base 40 is physically and electrically configured to connect with jack 44 and its circuitry. Modular contacts 42 allow plug base 40 to be used with multiple antenna configurations such as disk antenna element 46 and dipole antenna element 48. Modular contacts 42 provide electrical and physical connectivity to alternative antenna embodiments which can be plugged into base 40. This modular configuration allows this embodiment of the present invention to be used with multiple wireless devices with varying antenna requirements. It may also be used to allow a user to select among an assortment of alternative antennas to find one best suited to a given device or application.

Some types of antennas, including monopole antennas, experience improved range and performance when they radiate against. a ground plane. Some embodiments of the present invention may utilize ground plane elements, as shown in FIG. 4, within base plug 60 and/or within jack body 62. Ground plane elements may be constructed by placing conductive material on a substantially horizontal surface of jack body 62 or plug base 60. A metal sheet, metallic foil, metallic mesh or other suitable material may be bonded to the surface of body 62 or base 60. Alternatively, the ground plane elements 64 and 66 may be molded into base 60 or body 62. In order to provide a continuous ground place without holes or discontinuities base ground plane element 64 may be electrically and physically connected to body ground plane element 66 to form a single ground plane. Ground plane elements 64 and 66 may also be connected to elements within a device or expansion card to further increase ground plane size and performance. When base 60 is plugged into jack body 62, the gap in body ground plane element 66 formed by the presence of aperture 72 is filled with base ground plane element 64 thereby forming a unitary ground plane without holes and discontinuities. Electrical connection between base ground plane element 64 and body ground plane element 66 may be achieved using a linking conductor 68 which forms an electrical contact between the two ground plane elements. Once antenna 70 and base plug 60 are in place in jack aperture 72, antenna 72 may radiate against the ground plane elements and obtain greater range and performance.

The commonly used miniature 8-pin and miniature 6-pin connectors known in the art are typically used in applications that require only 2 to 4 pins. The additional pins are typically not necessary and often go unused. Embodiments of the present invention use these unused conductors for additional functionality. Some of the unused conductors may be used as transmission line conductors for the antenna leads. Additional conductors may be used to perform switching operations whereby circuitry in a device or expansion card is activated or deactivated according to the position of the antenna within the device's jack. In one embodiment comprising a combination wireless LAN adapter and a wired LAN adapter, previously unused conductors are used to switch between the wireless circuitry which is activated when an antenna is inserted into the jack and wired circuitry which is activated when the antenna is removed from the jack. Similar switching can be performed for combination wireless modem and wired modem cards as well as other combinations of electronic devices. Switching and activation may utilize a pull-up resistor configuration to accomplish this task. Other circuitry may also be used and digital circuitry, including multiplexor adaptations may be used.

Impedance matching circuitry may also be located within the antenna, base plug, jack or other elements of the present invention. In some embodiments, impedance matching circuitry is located within a base plug 30, 40 or 60 to improve antenna performance and compatibility.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. A removable flex antenna configured for selective use with a portable electronic apparatus, the antenna comprising:

a removable flex radiating and receiving element that is selectively positioned in one of a variety of positions; and an RJ-type plug coupled to the radiating and receiving element, wherein said plug is configured to selectively couple with a retractable RJ-type physical/electrical media connector of the portable electronic apparatus when said RJ-type physical/electrical media connector is in an extended position.

2. The antenna of claim 1, wherein said radiating and receiving element is configured to operate in a range around 2.4 GHz.

3. The antenna of claim 1, wherein said radiating and receiving element is a monopole antenna.

4. The antenna of claim 1, wherein said radiating and receiving element is a dipole antenna.

5. The antenna of claimed wherein said radiating and receiving element is a patch antenna.

6. The antenna of claim 1, wherein said plug comprises at least a partial ground plane for said antenna.

7. A portable electronic apparatus comprising:

a retractable RJ-type physical/electrical media connector, said connector being capable of moving from a retracted position interior to said electronic apparatus to an extended position exterior to said electronic apparatus; and a removable flex antenna configured to plug into said connector when said connector is in an extended position.

8. The apparatus of claim 7, wherein said connector comprises at least a partial ground plane for said antenna.

9. The apparatus of claim 7, further comprising a locking mechanism that is configured to selectively hold said antenna plugged into said connector.

10. The apparatus of claim 7, further comprising first and second ground plane elements, wherein each of said first and second ground plane elements are coupled to at least one of (i) said connector and (ii) a plug of said antenna, and wherein a linking connector couples said first ground plane element with said second ground plane element.

11. In a system that includes a portable electronic apparatus comprising a removable flex antenna configured to plug into a retractable RJ-type physical/electrical media connector when the connector is in an extended position, a method for selectively providing wireless communication, the method comprising the steps for:

providing the removable flex antenna;

extending the retractable RJ-type physical/electrical media connector of the portable electronic apparatus into the extended position;

plugging the antenna into the connector; and using the antenna for wireless communication.

12. The method of claim 11, further comprising the step for using a locking mechanism to hold the antenna plugged into the connector.

13. The method of claim 11, wherein the step for using further comprises the step for using the antenna to increase a transmission range of the portable electronic apparatus.

14. The method of claim 11, further comprising the step for using a pin of the media connector as a transmission line conductor for a lead of the antenna.

15. The method of claim 11, further comprising the step for performing impedance matching to improve at least one of:

(i) antenna performance; and (ii) compatibility.

16. The method of claim 11, further comprising the step for using a pin of the media connector to perform a switching operation.

17. The method of claim 16, wherein the step for using the pin of the media connector to perform the switching operation comprises the step for selectively activating circuitry of the apparatus.

18. The method of claim 17, wherein the step for selectively activating circuitry comprises the step for selectively switching between wireless circuitry that is activated when the antenna is plugged into the connector and wired circuitry that is activated when the antenna is unplugged from the connector.

19. The method of claim 17, wherein the step for selectively activating circuitry further comprises using a pull-up register configuration to accomplish the switching operation.

* * * * *